US010005309B2

(12) United States Patent
Fuhse et al.

(10) Patent No.: US 10,005,309 B2
(45) Date of Patent: Jun. 26, 2018

(54) SECURITY ELEMENT HAVING GROOVE- OR RIB-SHAPED STRUCTURAL ELEMENTS

(71) Applicant: GIESECKE & DEVRIENT GMBH, Munich (DE)

(72) Inventors: Christian Fuhse, Otterfing (DE); Hans Lochbihler, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days. days.

(21) Appl. No.: 14/762,834

(22) PCT Filed: Jan. 29, 2014

(86) PCT No.: PCT/EP2014/000245

§ 371 (c)(1),
(2) Date: Jul. 23, 2015

(87) PCT Pub. No.: WO2014/117938

PCT Pub. Date: Aug. 7, 2014

(65) Prior Publication Data

US 2015/0352884 A1 Dec. 10, 2015

(30) Foreign Application Priority Data

Jan. 31, 2013 (DE) ..... 10 2013 001 734

(51) Int. Cl.
*B42D 25/324* (2014.01)
*B42D 25/00* (2014.01)
(Continued)

(52) U.S. Cl.
CPC ..... *B42D 25/30* (2014.10); *B42D 25/00* (2014.10); *B42D 25/29* (2014.10); *B42D 25/324* (2014.10);
(Continued)

(58) Field of Classification Search
CPC ..... B42D 25/324; B42D 2033/24; B42D 2033/18
(Continued)

(56) References Cited

U.S. PATENT DOCUMENTS 4,715,623 A * 12/1987 Roule ..... B42D 25/00 283/91
6,226,127 B1 * 5/2001 Dunn ..... G09F 19/14 283/91
(Continued)

FOREIGN PATENT DOCUMENTS

AU 2010219575 B2 3/2013
CN 1228849 A 9/1999
(Continued)

OTHER PUBLICATIONS

Chinese Search Report from corresponding Chinese Application No. 2014800058053, dated Feb. 17, 2016.
(Continued)

*Primary Examiner* — Kyle R Grabowski
(74) *Attorney, Agent, or Firm* — Workman Nydegger

(57) ABSTRACT

A security element for manufacturing value documents, such as banknotes, checks or the like, comprises a top on which a microrelief structure is developed that has at least two sub-regions that each comprise a plurality of groove- and/or rib-shaped structural elements that lie adjacent to one another and extend along a longitudinal direction, and are reflecting or backscattering. The longitudinal directions of the sub-regions are different, and the structural elements are each not resolvable with the naked eye with respect to the width transverse to the longitudinal direction, and fan out incident parallel light achromatically in a fan that lies transverse to the longitudinal direction and has an opening angle of at least 30°.

17 Claims, 4 Drawing Sheets

(51) Int. Cl.
*B42D 25/30* (2014.01)
*B42D 25/40* (2014.01)
*B42D 25/29* (2014.01)

(52) U.S. Cl.
CPC ..... *B42D 25/40* (2014.10); *B42D 2035/34* (2013.01); *B42D 2035/50* (2013.01)

(58) Field of Classification Search
USPC ..... 359/572, 479
See application file for complete search history.

(56) References Cited

U.S. PATENT DOCUMENTS

| | | | |
|---|---|---|---|
| 6,266,187 | B1 | 7/2001 | Dunn et al. |
| 6,870,678 | B2 | 3/2005 | Tompkin et al. |
| 2004/0057113 | A1 | 3/2004 | Tompkin |
| 2007/0139744 | A1 | 6/2007 | Argoitia et al. |
| 2008/0258456 | A1 | 10/2008 | Rahm et al. |
| 2013/0250419 | A1 | 9/2013 | Lochbihler |

FOREIGN PATENT DOCUMENTS

| | | | |
|---|---|---|---|
| CN | 1236441 | A | 11/1999 |
| CN | 1423798 | A | 6/2003 |
| CN | 102292219 | A | 12/2011 |
| DE | 102005061749 | A1 | 7/2007 |
| DE | 102007009646 | A1 | 8/2008 |
| WO | 9808131 | A1 | 2/1998 |
| WO | 9820382 | A1 | 5/1998 |
| WO | 2003084765 | A2 | 10/2003 |
| WO | 2010034420 | A1 | 4/2010 |
| WO | 2011079347 | A1 | 7/2011 |
| WO | 2012048847 | A1 | 4/2012 |
| WO | 2012069163 | A1 | 5/2012 |

OTHER PUBLICATIONS

German Search Report for corresponding German Application No. 102013001734.3, dated Apr. 2, 2013.
International Search Report for corresponding International PCT Application No. PCT/EP2014/000245, dated Jun. 6, 2014.

* cited by examiner

SECURITY ELEMENT HAVING GROOVE- OR RIB-SHAPED STRUCTURAL ELEMENTS

BACKGROUND

The present invention relates to a security element for manufacturing value documents, such as banknotes, checks or the like, that comprises a top on which is developed a microrelief structure that has at least two sub-regions that each comprise a plurality of groove- or rib-shaped structural elements that lie adjacent to one another and extend along a longitudinal direction, and are reflecting or backscattering, the longitudinal directions of the sub-regions being different.

The present invention further relates to a value document having such a security element.

The present invention also relates to a manufacturing method for a security element for value documents, such as banknotes, checks or the like, a substrate being provided that comprises a top, and on the top, a microrelief structure being developed that has at least two sub-regions that each comprise a plurality of groove- or rib-shaped structural elements that lie adjacent to one another and extend along a longitudinal direction, and are reflecting or backscattering, the longitudinal directions of the sub-regions being different.

In the prior art, security elements are known that provide optically variable areal patterns. Such optically variable areal patterns can produce running effects or three-dimensional-appearing depictions. Here, the effects are achieved through diffraction gratings (e.g. in the form of holograms), micromirrors or a combination of microlenses and microimages.

WO 2012/069163 A1 discloses a security element that consists of retroreflectors that are provided with a color-variable coating. Through an interplay of single and multiple reflections in the retroreflectors having the angle-dependent color of the coating (especially thin-film coating having an angle-dependent "colorshift"), special color effects are produced. As a special case, groove structures are disclosed as retroreflectors that realize pump and running effects. The cited pump or running effects refer to moving color changes. It is further mentioned that, with such groove structures, it is possible to realize also three-dimensional-appearing depictions by varying the groove direction.

WO 2011/079347 A1 discloses how to produce three-dimensional effects with groove- or rib-like structures. For this, either the structures can follow the height contour of a bulged area or, with the structures, different views of an object for the left and right eye of a viewer can be provided.

WO 2012/048847 A1 discloses a security element that provides depictions that are composed of points or lines that seemingly float in front of or behind the plane of the security element. Said points or lines are referred to as light spots and are given by focus points and lines of concave or convex mirrors. To achieve this effect, a viewer must see, in each case, the light spots of a lens structure with both eyes. In a cylindrical lens structure, the appropriate focal lines are perceived at different locations with both eyes. The height or depth at which the light spot floats in front of or behind the plane of the security element depends on the focal length. The required structures are relatively complex to manufacture.

SUMMARY

The object of the present invention is to specify a security element of the kind cited above that provides an effect that is difficult to reproduce or imitate and, at the same time, is easier to manufacture, especially as regards the structures to be produced.

According to the present invention, this object is solved with a security element of the kind cited above in which the structural elements are each not resolvable with the naked eye with respect to the width transverse to the longitudinal direction, and fan out incident parallel light achromatically in a fan that lies transverse to the longitudinal direction and has an opening angle of at least 30°.

The object is further solved with a manufacturing method of the kind cited above in which the structural elements are each not resolvable with the naked eye with respect to the width transverse to the longitudinal direction, and are developed in such a way that they fan out incident parallel light achromatically in a fan that lies transverse to the longitudinal direction and has an opening angle of at least 30°.

The present invention manages to achieve the running effects and three-dimensional-appearing depictions mentioned in WO 2012/069163 A1 also with microrelief structures that have no color coating, since the reflection is achromatic. A grayscale effect is achieved. The effects are not based on a color effect that is different in some regions, for which the cited WO publication combines retroreflectors and a special thin-film coating, but rather display different brightnesses in reflection in some regions.

The structural elements are preferably not developed as retroreflectors. That makes manufacture easier because flatter structures can be used. Further, the advantage is achieved that said effects can be realized on both sides, in other words, also on the back of an appropriately designed foil, which is not possible with retroreflectors that can retroreflect only to one side.

Also in contrast to WO 2012/048847 A1, the structures are much smaller, which makes it easier to mold them in foil material. A viewer no longer sees individual light spots that originate from the resolution of a lens structure, but rather only the entirety of all structural elements that can no longer be resolved with the naked eye without magnification means. The display properties of the structures according to the present invention are no longer perceptible for a viewer.

The present invention thus uses an optically variable areal pattern based on optically effective relief structural elements that fan out incident parallel light about a specified axis that is determined by the longitudinal axis of the structural elements. If, in the different sub-regions, optically effective structural elements are arranged that fan out the light about different axes, then these sub-regions appear (in each case with reference to the light source) light or dark to a viewer depending on the viewing angle. If one rotates such a security element in its plane, which is defined by the surface, one can perceive how individual regions alternatingly become light or dark. The brightness of the individual regions depends, in the case of perpendicularly incident light, on whether the longitudinal direction lies transverse to an observation plane or not. Here, the observation plane is spanned by the perpendicular to the surface of the security element, the viewing direction and the illumination direction. In the case of non-perpendicular direction of light incidence, the fanning out generally need not lie in a plane, but rather can also lie in a curved surface.

In this way, through appropriate design of the sub-regions, it is possible to produce cinematic effects or three-dimensional depictions. The effects provided by the present invention are characterized by a good perceptibility, and the security element is comparatively easy to manufacture.

The fanning out of the incident light occurs through the achromatic, ray-optically-acting microrelief structure. This is advantageous compared with the use of diffraction gratings (e.g. holograms), since the effectiveness of such microrelief structures is significantly better. While, in the case of diffraction gratings, in practice, a considerable share of the incident light goes to the zeroth diffraction order and so is lost for the fanning out and thus for the effect, with a microrelief structure according to the present invention, it is possible to achieve a well defined scattering angle range of nearly constant brightness distribution. In other words, the light distribution in the fan is largely homogeneous, and not significantly more radiation is reflected in the direction of the mirror-reflecting reflex of the surface of the security element than in the rest of the fan.

Preferably, the structural elements are developed in such a way that perpendicularly incident light is fanned out symmetrically about the surface normal.

The fanning out advantageously occurs substantially uniformly, that is, within the opening angle of the fan, a substantially uniform distribution of the reflected or backscattered light results. Here, a substantially uniform distribution of the reflected or backscattered light is especially understood to mean that, within the opening angle of the fan, the observed brightness of the reflected or backscattered light varies by no more than a factor of 3, preferably by no more than a factor of 2, particularly preferably by no more than a factor of 0.5.

Creases in the profile of the structural elements would be detrimental to such a uniform distribution. According to the present invention, the profile of every groove-shaped structural element is therefore smooth, such that, from a large viewing angle range, a similarly high reflected brightness is observed as long as the viewing and illumination lie in the plane of the fan. Advantageously, the structural elements according to the present invention have, in each case seen transverse to the longitudinal direction, a profile that exhibits no discontinuity.

The larger the opening angle of the fan is, the larger the viewing angle range is from which a movement effect can be observed when the security element is rotated. Further, it is conducive to a strong effect if the structural elements reflect or backscatter the incident parallel light along the longitudinal direction in such a way that it is fanned out by no more than 10°, preferably by no more than 5°. A larger fanning out in said direction would cause the structural elements to scatter nearly isotropically again to appear increasingly matte, such that, ultimately, the rotation of the longitudinal direction with respect to the viewing plane no longer produces any good cinematic effects, etc.

In an easily manufacturable design, the security element effects a pattern that lies in front of a background. The rotation in the image plane effects a contrast inversion, since the pattern and its background differ with respect to their longitudinal direction of the structural elements, the longitudinal directions ideally lying perpendicular to each other. The pattern and its background form two sub-regions. In a first orientation, the pattern appears light and the background dark. If the security element is rotated in the image plane, that is, if the viewing plane is rotated with respect to the longitudinal direction, light and dark switch.

However, the different orientations of longitudinal directions are not limited to two directions or even to a perpendicular position to each other. Through a continuous variation of the orientation of the longitudinal directions, also pump or running effects can be realized. Such movement effects draw particularly the attention of a viewer to them, and are thus advantageously suitable as easily perceptible features for authenticating a security element.

Further, through suitable orientations of the longitudinal directions, also effects can be realized that present a three-dimensional object to a viewer. For this, a piece of information about the height of the object to be rendered or a distance to the object to be rendered can be encoded by the orientation of the longitudinal direction of the individual structural elements. In this case, a viewer perceives a laterally different parallax in the planar surface provided with the microrelief structure.

The structural depth lies on the scale of half the structural width. Since, in many applications, one does not want to exceed a maximum thickness of the security element, widths of the groove- or rib-shaped structural elements of smaller than 30 μm are preferred in order to keep the thickness of the security element as small as possible. A lower limit for the width is about 2 μm, due to the diffraction behavior of the light on structures on scales of the wavelength. This is because, for smaller widths, the scattering or the diffraction share of the reflected light increases. Thus, for very small structural elements, for example for widths smaller than 10 μm, irregular or aperiodic structures can advantageously be used in order to avoid, for example, diffraction-induced color effects. Further, the width of the groove- and/or rib-shaped structural elements is chosen such that an individual of the groove- and/or rib-shaped structural elements can no longer be resolved by the viewer.

Here, the dimension of the groove- or rib-shaped structural elements in the longitudinal direction is preferably at least 5 times larger, preferably at least 6 times larger, particularly preferably even 10 times or much larger still than the dimension or width in the transverse direction perpendicular to the longitudinal direction.

In their profile, the structural elements can be developed in many different variants. In particular, it is advantageous when they are convex from the top. For the structural elements, particularly profiles that include an arc of a circle, of an ellipse or of a parabola are preferred. Structural elements that are formed by grooves or ribs whose area corresponds to a portion of a lateral surface of a circular cylinder are a particularly easy-to-manufacture variant that displays a good optical effect.

In the case of perpendicular incidence, multiple reflections of the incident light would cause erratic changes in the reflected brightness in the fan. To avoid such multiple reflections as are absolutely mandatory in retroreflectors, it is preferable to design the structural elements in such a way that their slope with respect to the plane spanned by the surface is so small that it includes an angle of no more than 45°, preferably no more than 30°.

To improve the brightness effect, it is preferable that the structural elements comprise, at least in some regions, a reflective or reflection-increasing coating, especially a metalization, a high-index coating, a thin-film element having a color-shift effect, a coating having liquid crystals, and/or a coating having a metallic-appearing or reflective printing ink.

The different sub-regions can be nested within each other such that, from different viewing directions, different depictions result for a viewer. In this way, a stereogram or, if the security element is moved appropriately, a cinematic effect can be produced.

The development of the security element on a transparent substrate foil permits the security element to be used from both sides with the effect produced by the security element.

With the security element according to the present invention, it is possible to realize especially also quasi-endless movement effects, that is, effects in which, when the security element is rotated, a movement goes on continuously without coming to an end. For example, many regions whose longitudinal directions differ in each case by 5° could be arranged in succession. After 180°/5°=36 regions, the original orientation is then present again. If, for example, 72 such regions are arranged in succession on a line, then, in each case, two of the regions are seen lighting up brightly. If the security element is rotated, said bright spot wanders continuously further from region to region. If the security element is rotated by a full 360°, then a bright reflection wanders, for example, continuously from the first region to the last region 72, the initial situation, of course, being present again in the end. In other words, the effect does not jump and is easy to observe from all directions upon rotation. Instead of the number 72, also another number of regions and/or also another angle difference in the longitudinal directions than the mentioned 5° can, of course, be used. The regions can also be arranged in other shapes, for example on a circle.

With the security elements according to the present invention, it is possible to produce also depictions that, when the security element is rotated, seemingly move at another rotation speed. In this way, there could be nested within each other, for example, 36 different regions that are visible from rotation directions that, in each case, differ by 5° and, in each case, display practically identical depictions that, however, are rotated against each other. When the security element is rotated, a viewer thus sees a depiction that seemingly rotates differently than the security element itself (or, for example, a banknote that bears the security element). The depictions can especially be designed such that the impression is created that, like a compass needle, the depiction does not co-rotate. Alternatively, also the impression of a significantly faster movement can be created. Furthermore, embodiments are realizable in which sub-regions appear to rotate at different speeds, such as different-sized gearwheels in a gearbox.

For the manufacturing method according to the present invention, especially direct-exposure techniques, e.g. with the aid of a laser writer, may be used. The manufacture can be done analogously to the known manufacturing method for microlenses. Through direct exposure and with the aid of a laser writer, the original of the microrelief structure is inscribed in a substrate coated with photoresist, and subsequently, the exposed portion of the photoresist removed. An exposed original can subsequently be galvanically molded and thus an embossing stamp produced. Finally, the structure is replicated through an embossing process, for example in UV lacquer on foil. Alternatively, a nanoimprint method can be used. This photolithographic manufacturing method offers many design possibilities in the choice of the geometry of the microrelief structure.

Thereafter, preferably an evaporation of the surface is carried out to increase reflection, for example a metal coating. For this, electron beam evaporation, sputtering or thermal vacuum evaporation, for instance, may be used. Finally, for protection, the structure is preferably laminated with a cover layer.

The manufacturing method according to the present invention can be developed in such a way that the described preferred developments and embodiments of the security element are manufactured.

The security element can especially be developed as a security thread, tear strip, security band, security strip, patch, or as a label. In particular, the security element can span transparent regions or gaps.

The security element can especially be part of a not yet circulatable precursor to a value document that can comprise, in addition to the security element according to the present invention, for example also further authenticity features (such as luminescent substances provided in the volume). Here, on the one hand, value documents are understood to be documents comprising the security element. On the other hand, value documents can also be other documents and objects that can be provided with the security element according to the present invention so that the value documents comprise non-copyable authenticity features, making an authenticity verification possible and simultaneously preventing undesired copies. Chip or security cards, such as bank or credit cards, are further examples of a value document.

It is understood that the above-mentioned features and those yet to be explained below are usable not only in the specified combinations, but also in other combinations or alone, without departing from the scope of the present invention.

BRIEF DESCRIPTION OF THE DRAWINGS

The present invention will be explained in greater detail below by way of example by reference to the attached drawings, which also disclose features that are essential to the invention. Shown are.

DETAILED DESCRIPTION OF VARIOUS EMBODIMENTS

Figure 1:
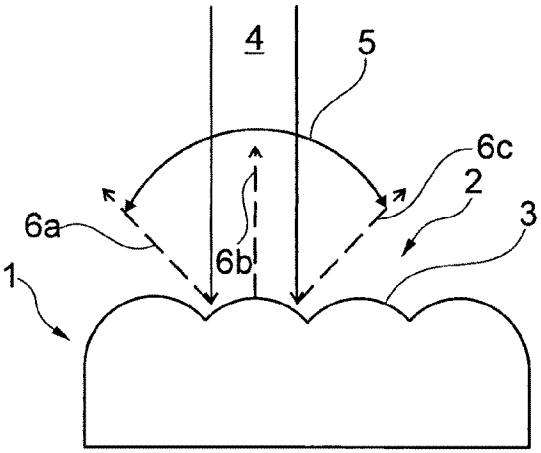
FIG. 1 a schematic sectional view to clarify the structure of a security element that comprises a microrelief structure, FIGS. 2*a* and 2*b* in (a), a scanning electron microscope image of an exemplary embodiment of the microrelief structure in FIG. 1, and in (b), a schematic rendering of the scanning electron microscope image from (a), FIGS. 3 and 4 possible modifications of the microrelief structure of the security element, FIG. 5 exemplary sub-regions of the microrelief structure to clarify possible image effects, FIG. 6 an exemplary embodiment of the microrelief structure for producing a depth effect, FIG. 7 an embodiment of the microrelief structure for producing a running effect, FIG. 8 a further embodiment of the microrelief structure for producing a running effect and FIG. 9 a schematic diagram to clarify the variation of a longitudinal direction of the microrelief structure, likewise for producing a movement effect.

FIG. 1 shows, schematically, a sectional view through a security element 1 that comprises a reflective microrelief structure 2 that is formed in a substrate. On its top, said substrate comprises multiple structural elements that, in the case shown, are formed as ribs that extend perpendicularly to the drawing plane and, transverse to said longitudinal direction, have the profile of an arc on their surface. The individual structural elements 3 thus have a section of a circular cylinder lateral surface. Alternatively to said design, also other profiles are possible, e.g. elliptical or parabolic shapes, as the basis of the profile. In this regard, reference is made to the above, general portion of the description.

Parallel incident light 4 is reflected in a fan 5 on every structural element 3 of the microrelief structure 2. Reflected light beams 6*a*, 6*b* and 6*c* are marked by way of example. The angle range of the fan 5 is at least 30°, preferably no smaller than 45° and particularly preferably (such as in the case marked) at least 90°. In the other direction, that is, in the diagram in FIG. 1, perpendicular to the drawing plane, no appreciable widening of the beam takes place. This is to be understood to mean that the fanning out measures no more than 10°, particularly preferably less than 5°. A greater fanning out in said direction, that is, perpendicular to the drawing plane and thus along the longitudinal direction of the structural elements 3, would cause the individual structural elements 3 to scatter nearly isotropically again, which would cause the surface of the microrelief structure 1 to appear increasingly matte.

Figure 2B:
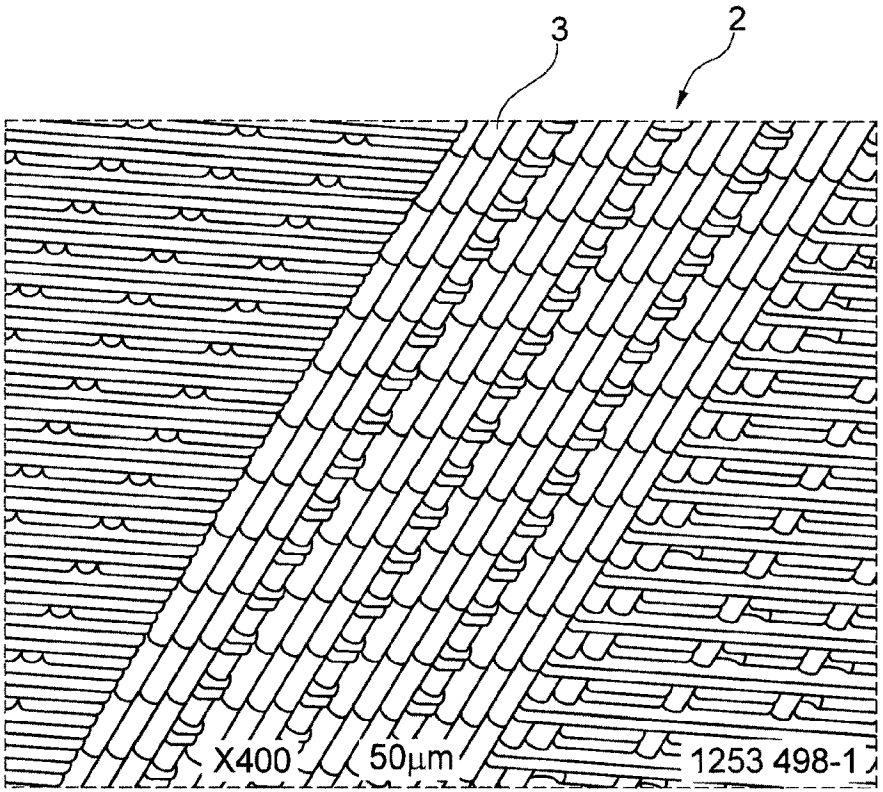
Figure 2A:
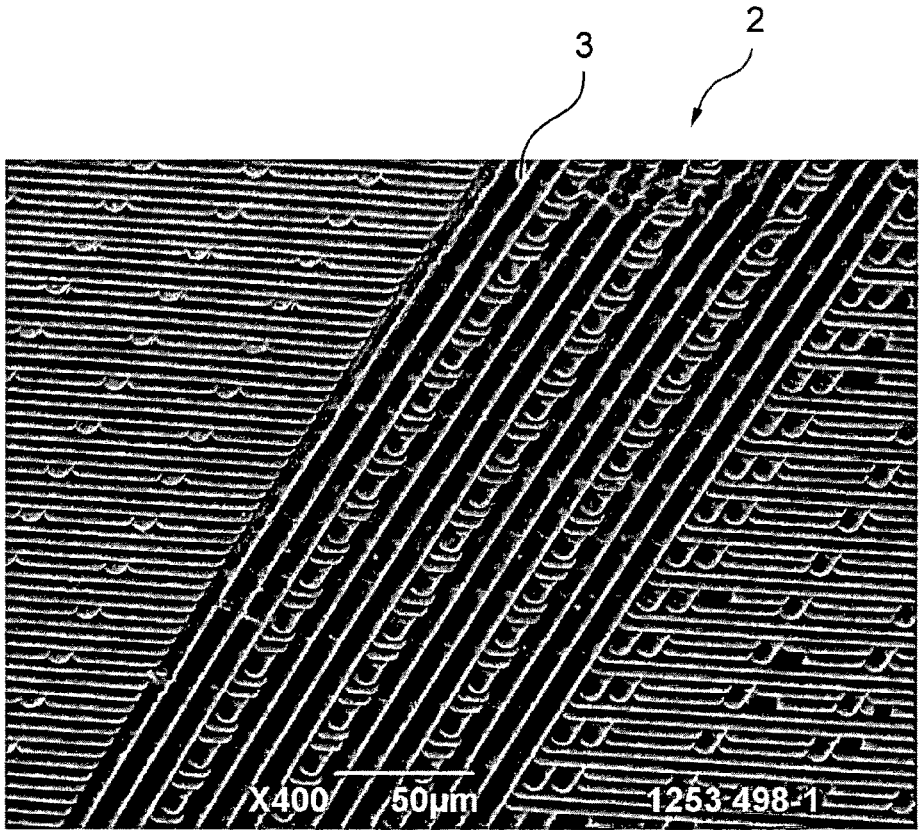

FIG. 2 shows a scanning electron microscope image of an exemplary microrelief structure 2. Note that, in the image shown in FIG. 2*a*, the sample was incorporated in such a way that the diagram in FIG. 2*a* looks at the microrelief structure 2 from below. FIG. 2*b* reproduces the scanning electron microscope image schematically. FIG. 2 shows the following optional features of the security element or the microrelief structure 2:

The structural elements 3 vary with respect to their longitudinal direction. In the exemplary case in FIG. 2, two different longitudinal directions are present that are rotated against each other by 90°. Other angle positions are possible.

The width of the individual structural elements 3 transverse to the longitudinal direction is not resolvable with the naked eye. As the scale marked in FIG. 2 shows, in the exemplary embodiment, said width is a few micrometers and thus below a structure size of 100 μm, which would still be perceptible with the naked eye.

The individual structural elements 3 can differ both with respect to the width measured transverse to the longitudinal extension and with respect to their length measured along the longitudinal direction. Also the length can be such that an individual structural element is no longer perceptible with the naked eye. However, this is not mandatory, as the in some cases longer through-running structural elements 3 in FIG. 2 illustrate.

Figure 5:
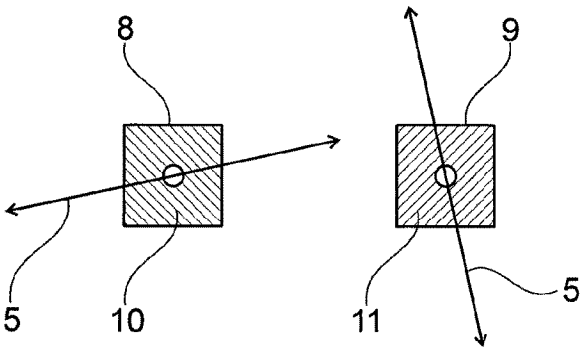
Figure 3:
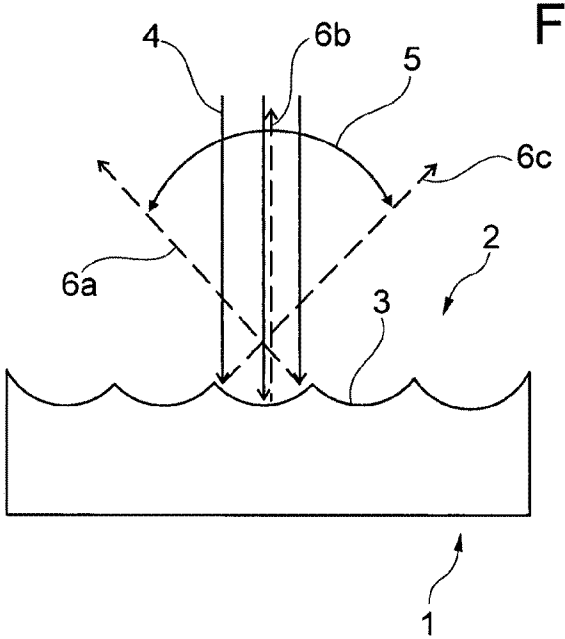

Before possible embodiments of the profiles of the structural elements 3 are addressed by reference to FIGS. 3 and 4, the operating principle or the effect that the structural elements 3 of the relief structure 2 effect, is explained by reference to FIG. 5. FIG. 5 shows two sub-regions 8 and 9 that differ with respect to the longitudinal direction 10, 11 of their structural elements 3. The longitudinal direction is symbolized in each case by the direction of the hatching in the sub-regions 8 and 9. In the example in FIG. 5, the longitudinal directions 10 and 11 lie at right angles to each other. With the double arrows, the direction of the fan 5 is illustrated, in which parallel incident light 4 is reflected. The diagram in FIG. 5 assumes perpendicular incidence of the light on the surface of the security element 1. Of course, in the case of oblique incidence, the fan 5 tilts in such a way that, with respect to the surface normal of the security element, it lies symmetrically to the direction of light incidence. Here, the fan 5 need not lie in a plane, but rather can also, if applicable, lie in a curved surface. An observer located in the region of the fan 5 of the sub-region 8 sees said sub-region as light. The sub-region 9, in contrast, whose fan 5 lies perpendicular thereto, appears dark to him. If the observer moves relative to the security element, for example in that the security element is rotated, then the brightness in which the sub-regions 8 and 9 appear changes. If the security element is rotated by 90°, a complete contrast reversal takes place.

Said effect characterizes the security element 1. If, for example, the structure according to sub-region 8 is used for the foreground of a motif, and the structure of the sub-region 9 for the background, a contrast inversion occurs between foreground and background when the security element is rotated by 90°. For an observer, the motif reverses to its negative.

The effect according to the present invention can, of course, be achieved not only with the structure according to FIG. 1 or different rib-shaped, in other word, convex structural elements 3, but also with groove-shaped, that is, concave structural elements. Such an example is depicted in FIG. 3. Here, exactly the same effect occurs.

Figure 4:
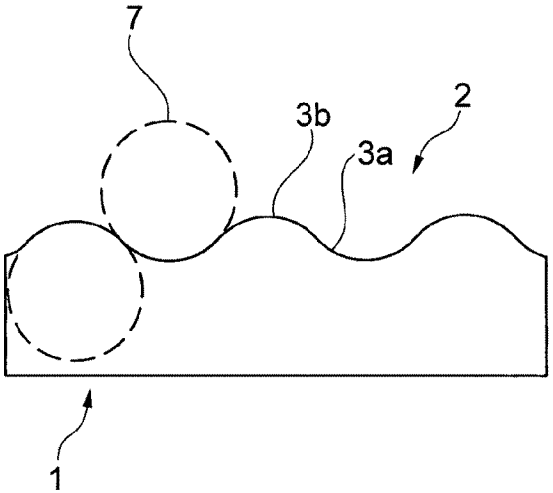

FIG. 4 illustrates that concave structural elements 3*a*, also combined with convex structural elements 3*b*, can be alternated in the exemplary embodiment. FIG. 4 illustrates this by way of example with structural elements 3, which, in profile, follow an arc section of a circle 7. The microrelief structure 2 in FIG. 1 thus has, overall, a wavelike structure.

In the microrelief structures 2, the profile depth is chosen such that, preferably, no multiple reflection takes place, since that would lead to an erratic, non-uniform distribution of the brightness in the fans 5.

Figure 6:
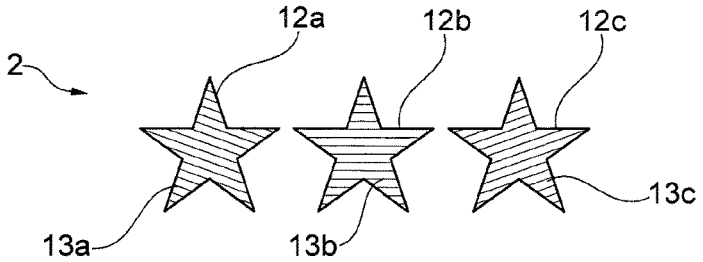

FIG. 6 illustrates a variant in which the sub-regions 8, 9 in FIG. 5 are designed in the form of a motif that, by way of example, is developed as a star. The motifs 12*a*, 12*b* and 12*c* differ in the longitudinal directions 13*a*-13*c* of their structural elements 3. In the diagram in FIG. 6 with three motifs 12*a*, 12*b* and 12*c*, the viewer sees a running effect when he rotates the security element. Depending on the position, first the motif 12*a*, for example, is light, then the motif 12*b* and then the motif 12*c*. The brightness differs due to the orientation of the longitudinal directions 13*a* to 13*c*.

In a particular embodiment, the security element effects a stereoscopic effect. Two sub-regions, here the motifs 12*a* and 12*c*, are spaced apart in such a way that, if the viewing distance is suitable, the left eye of the viewer is in the fan of the motif 12*a*, and the right eye in the fan of the motif 12*c* (the motif 12*b* is then dropped). The viewer therefore sees the motif at different positions in his left and right eye, making it appear to him, depending on the rotational position, in front of or behind the security element. In this way, a stereogram having a depth effect is obtained. The depth at which the viewer suspects the presented motif depends on the spacing of the motifs 12*a* and 12*c*. The viewer sees the entirety of all structural elements of the motif 12*a* together in the same brightness. This applies analogously for the motif 12*b*.

Figure 7:
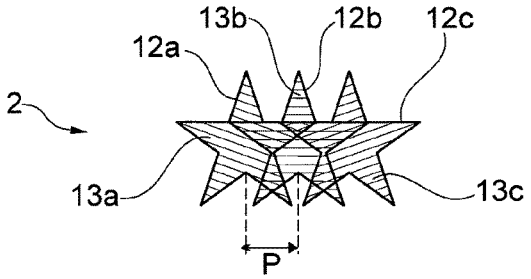

FIG. 7 shows a further embodiment of the security element 1, in which the microrelief structure effects a running effect. The motifs 12*a* to 12*c* in FIG. 6 are now developed in such a way that they lie at a spacing P that is smaller than the extension of the motif. They are, in part, nested overlapping. Here, in the overlapping region, structural elements 3 of the one motif alternate with structural elements 3 of the other motif. In the diagram in FIG. 7, this is illustrated schematically by an intersection of the longitudinal directions. Of course, at a given areal region, only one structural element 3 can be present, either with the longitudinal direction of the one motif or the longitudinal direction of the other motif. Therefore, structural elements of different forms alternate in small areal regions within the overlap region.

Such an overlapping makes sense, for example, for a running effect in which the motif is to move nearly continuously and is not to jump. Of course, the regions can also display different motifs, e.g. the form of a symbol (e.g. €-sign) and the form of a value numeral. The regions can also have very complex forms and present, for example, a screened halftone image. Further, the regions can transition practically continuously from a first form into a second form, allowing also a transformation effect to be realized.

Figure 8:
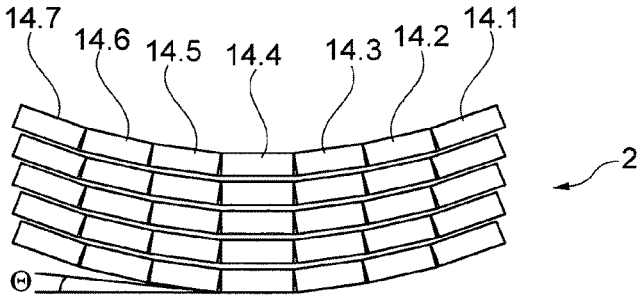

In more advanced embodiments, many regions are present that have slightly different longitudinal directions of the structural elements and, when rotated, appear, from different angles, light or dark to a viewer, as described above. If, for example, in the microrelief structure 2, there lie in a row many such regions 14.1-14.7 in which the longitudinal direction changes by only a small angle θ from one region to the next, then, upon rotation, said regions light up in succession. A running effect is created, as FIG. 8 illustrates.

Figure 9:
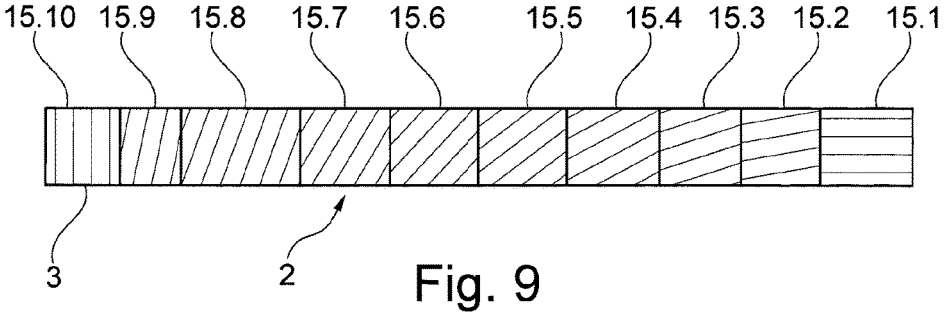

Similarly, it is possible to generate also a pump effect in that, for example, the position of the longitudinal direction is changed, in each case, by the same angle from a smaller depiction to the next larger one. The different orientations of the longitudinal directions of the structural elements 3 is not limited to arrangements that are perpendicular to each other, as was already explained above. Through a continuous or nearly continuous variation of the longitudinal directions, pump and running effects can be realized. FIG. 9 shows a top view of a microrelief structure 2 that comprises sub-regions 15.1 to 15.10 in which the longitudinal direction differs in each case by 10° between adjacent sub-regions. Here, the boundaries between the sub-regions are marked in the drawing only for illustration.

Although the movement effects are naturally actually aimed at movement when the security element is rotated, it has become evident that the effects are easily visible also when the security element is tilted. This is advantageous since, for example, it is easier for most people, or is possible more quickly, to tilt banknote about an arbitrary axis than to rotate it in a fixed plane.

The axes about which incident light is fanned out can also follow the height contour lines of a bulged area. It has become evident that such a security element then likewise appears to comprise such a bulge. Here, however, a loss of information results since, from the progression of the contour lines can be concluded only in which direction an area is inclined, but not whether it rises or falls, or how strongly it rises or falls. Thus, one cannot, for example, discern whether an area is bulged toward the front or back, or a large or small slope is present (one could not e.g. distinguish between the top view of a cone and of a sphere). Precisely in complex depictions such as a portrait, however, said loss of information is hardly apparent, but rather is apparently completed by the human brain on the basis of experience. This is often even very useful and advantageous, especially when a security element can be viewed from both sides: one then assumes, for example, from both sides, that a face is bulged toward the viewer, and that one does not look into a hollow mask from behind.

The security element can preferably be produced on the basis of a transparent substrate foil. It then offers an optically variable effect of comparable quality viewed from both sides. For example, seen from the front, the structure in FIG. 1 is present, and seen from the back, the structure in FIG. 3. This makes the security element particularly preferably suited for window regions of value documents or for security threads, pendulum threads, etc., in banknotes.

As structures that fan out light, for example, lens-like structures or structures having, in some pieces, circular, parabolic or elliptical cross sections can be used.

The structures can be convex or concave, without the optical effect differing seriously. It is also conceivable to use structures that are bulged alternatingly upwards or downwards (convex or concave), for example having a circular cross section. Also sinusoidal or sinus-like profiles are possible.

The structures are preferably designed in such a way that no multiple reflections of the (perpendicularly) incident light can occur that cause erratic changes in the reflected brightness. Thus, relief structures whose slope is so small that they include, locally with the macroscopic plane of the security element, only an angle of at most 45°, preferably at most 30°, are advantageous.

The structures can be regular or periodic, or also irregular (e.g. arrangement of scattering structures having circular cross sections that comprise irregularly varying radii).

In order for a ray-optical effect to dominate with respect to diffraction effects, structure sizes (e.g. periods in the case of a regular arrangement) of more than 3 μm, preferably more than 5 μm and particularly preferably more than 10 μm are used.

The structures imaged in the figures having their cross sections advantageously run into the drawing plane with a practically unchanged cross section. The dimension in said direction is advantageously at least 5 μm, particularly advantageously at least 10 μm or 20 μm in size, since otherwise, due to diffraction or scattering on the edges, a fanning out that is undesired here takes place also in a second direction.

The structural elements effect a reflection of the incident light. For this, it is preferred to coat them so as to be reflective or backscattering. They are preferably embossed on a substrate foil, for example in that, on the substrate foil, an embossing lacquer is applied that can be, for example, thermoplastic or radiation-curing.

The structural elements according to the present invention can also be combined, and especially nested, with other embossed structures, especially micromirror structures. For example, structural elements according to the present invention that produce a running effect can be nested with micromirror structures in such a way that, through the movement effect that is visible from a large viewing angle range, a micromirror depiction, e.g. a value numeral, then lights up brightly only in a very small angle range.

LIST OF REFERENCE SIGNS

1 Security element
2 Microrelief structure
3 Structural element
4 Light
5 Fan
6*a-c* Reflected light beams
7 Circle
8, 9 Sub-region
10, 11 Longitudinal direction
12*a-c* Motif
13*a-c* Longitudinal direction
14.1-14.7, 15.1-15.10 Sub-region

The invention claimed is:

1. A security element for manufacturing value documents comprises:

a top on which is developed a microrelief structure that has at least two sub-regions that each comprise a plurality of groove- and/or rib-shaped structural elements that lie adjacent to one another and extend along a longitudinal direction, and are reflecting or backscattering, the longitudinal directions of the sub-regions being different, wherein the structural elements are each not resolvable with the naked eye with respect to the width transverse to the longitudinal direction, the width transverse to the longitudinal direction being below 50 μm, and fan out incident parallel light achromatically in a fan that lies transverse to the longitudinal direction and has an opening angle of at least 30°, wherein the structural elements have an inclination angle of at most 45° with respect to a plane defined by the top, and wherein, within the opening angle of the fan, the fanning out of the incident parallel light results in a substantially uniform distribution of reflected or backscattered light.

2. The security element according to claim 1, wherein the fan has an opening angle of at least 45°.

3. The security element according to claim 1, wherein the structural elements reflect or backscatter the incident parallel light along the longitudinal direction in such a way that it is fanned out by no more than 10°.

4. The security element according to claim 1, wherein the structural elements, seen in each case transverse to the longitudinal direction, have a profile that exhibits no discontinuity.

5. The security element according to claim 1, wherein, seen from the top, the structural elements are convex.

6. The security element according to claim 1, wherein the width of the structural elements is, in each case, between 3 μm and 50 μm.

7. The security element according to claim 1, wherein the profile has a cross section that is an arc of a circle, of a parabola or of an ellipse.

8. The security element according to claim 7, wherein the structural elements are formed by grooves or ribs whose area corresponds to a portion of a lateral surface of a circular cylinder.

9. The security element according to claim 1, wherein the structural elements are provided, at least in some regions, with a reflective or reflection-increasing coating.

10. The security element according to claim 1, wherein the at least two sub-regions either are nested within each other, such that different depictions result for a viewer from different viewing directions, or are spaced apart in such a way that they present a stereogram.

11. The security element according to claim 1, wherein at least five sub-regions are present whose longitudinal directions are different, such that, when the security element is rotated about an axis that lies perpendicular to the surface, a cinematic effect is presented to a viewer.

12. The security element according to claim 1, wherein a plurality of sub-regions is present whose longitudinal directions differ, the longitudinal directions following a height contour line of a bulged area to present a 3-D effect to a viewer.

13. The security element according to claim 1, wherein it comprises a transparent substrate foil in which the microrelief structure is developed, the security element permitting, from both sides, perception of the effect produced by the security element.

14. The security element according to claim 1, wherein the structural elements are developed such that perpendicularly incident light is fanned out symmetrically about a surface normal.

15. The security element according to claim 1, wherein a depth of the structural elements is half of the width transverse to the longitudinal direction.

16. A value document having a security element according to claim 1.

17. A method for manufacturing a security element for value documents, wherein a substrate is provided that comprises a top, and on the top, a microrelief structure being developed that has at least two sub-regions that each comprise a plurality of groove- and/or rib-shaped structural elements that lie adjacent to one another and extend along a longitudinal direction, and are reflecting or backscattering, the longitudinal directions of the sub-regions being different, wherein the structural elements are each not resolvable with the naked eye with respect to the width transverse to the longitudinal direction, the width transverse to the longitudinal direction being below 50 μm, and are developed in such a way that they fan out incident parallel light achromatically in a fan that lies transverse to the longitudinal direction and has an opening angle of at least 30°, and wherein, within the opening angle of the fan, the fanning out of the incident parallel light results in a substantially uniform distribution of reflected or backscattered light such that within the opening angle of the fan, the observed brightness of the reflected or backscattered light varies by no more than a factor of 3.

* * * * *